United States Patent [19]

Honma

[11] Patent Number: 5,049,422

[45] Date of Patent: Sep. 17, 1991

[54] GOLF SHAFT

[75] Inventor: Yukihiro Honma, Yokohama, Japan

[73] Assignee: Honma Golf Club Mfg., Co., Ltd., Yokohama, Japan

[21] Appl. No.: 412,244

[22] Filed: Sep. 25, 1989

[30] Foreign Application Priority Data

Jan. 24, 1989 [JP] Japan ..... 1-13148

[51] Int. Cl.[5] ..... A63B 53/10

[52] U.S. Cl. ..... 428/34.6; 273/80 R; 273/80 B; 428/359; 428/113

[58] Field of Search ..... 428/34.6, 35.9, 113, 428/367, 368, 408; 273/77 R, 80 R, 80 B, 80 C

[56] References Cited

U.S. PATENT DOCUMENTS 4,082,277 4/1978 Van Auken et al. ..... 428/34.5

4,119,748 10/1978 Verbauwhede et al. ..... 428/113

*Primary Examiner*—James J. Seidleck

*Assistant Examiner*—Charles R. Nold

*Attorney, Agent, or Firm*—Jordan and Hamburg

[57] ABSTRACT

A shaft for a golf club which can exhibit a vibration characteristic close to that of a steel shaft without imparting at all the characteristics of a carbon shaft is constructed with metal fibers incorporated in an outer layer portion of a carbon shaft with the direction of the metal fibers specified approximately in the axial direction of the shaft.

12 Claims, 4 Drawing Sheets

FIG. 4

| KIND | DENSITY ($g/cm^3$) | DIAMETER OF WIRE (um) | TENSILE STRENGTH ($kgt/mm^2$) | MODULUS OF ELASTICITY ($kgf/mm^2$) | ELONGATION (%) | RUPTURE DRAW (%) |
|---|---|---|---|---|---|---|
| SUPERFINE METAL (Fe-C-Si-Mn GROUP) | 7.8 | 30 | 475 | 20000 | 4.0 | 53 |
| | 7.8 | 50 | 425 | 30000 | 4.2 | 57 |
| | 7.8 | 100 | 400 | 20000 | 4.5 | 55 |
| PIANO WIRE (82C) | 7.8 | 100 | 310 | 20000 | 3.2 | 51 |
| STAINLESS WIRE (SUS304) | 7.8 | 50 | 270 | 18000 | 3.2 | 60 |
| TITANIUM WIRE | 4.5 | 50 | 90 | 10800 | - | - |
| AMORPHOUS WIRE | 7.6 | 50 | 370 | 16000 | 4.0 | <5 |
| TITANIUM ALLOY WIRE | 4.43 | 100 | 100-120 | 11500 | - | - |

GOLF SHAFT

BACKGROUND OF THE INVENTION

The present invention relates to golf shafts, and more particularly to a golf shaft which can exhibit a vibration characteristic extremely close to the vibration characteristic exhibited by a steel shaft without impairing at all the characteristic of a so-called carbon shaft.

Golf shafts include a steel shaft, a carbon shaft and the like. The carbon shaft has the merit in that the carbon shaft is ligher than the steel shaft, and therefore carbon shafts are being widely habitually used these days. However, the carbon shaft has a problem in that a sense of flexure like a steel shaft cannot be obtained.

This will be explained with reference to FIG. 6 which shows attenuation of a vibration. In FIG. 6, the solid line indicates the case of a carbon shaft whereas the broken line indicates the case of a steel shaft. As will be apparent from FIG. 6, in the case of the steel shaft, since the damping factor is low, it takes some time till the vibration is damped. On the other hand, in the case of the carbon shaft, since the damping factor is high, the vibration is damped early.

The damping characteristic of vibration will be discussed in relation to the swinging operation of golf. A golf swing moves to a back swinging from in address state and thence to a top state. Then, a down swing is effected to hit a ball.

At that time, in the case of the steel shaft, the shaft is rearwardly flexed by the back swing, and the flexed state thereof is maintained in the course of the down swing. This results from the fact that the damping factor of vibration is low, as previously mentioned. The shaft is returned forwardly when it hits a ball, and therefore, a sufficient head speed is obtained.

On the other hand, in the case of the carbon shaft, since the damping factor of vibration is high, as previously mentioned, the flex state cannot be sufficiently maintained in the course of the down swing and the shaft becomes returned. Therefore, the "sense of flexure" is not sufficiently secured and the head speed becomes slow.

A proposal has been made, as shown in FIG. 7, in which metal fiber (for example, amorphous fiber, stainless steel fiber, etc.) 103 is spirally wound about an inner layer or an outer layer of a carbon shaft 101.

However, the aforementioned proposal is made principally to prevent torsion of the shaft but not to improve the flexing characteristics.

SUMMARY OF THE INVENTION

The present invention has been achieved in view of the foregoing. It is an object of the present invention to provide a golf shaft which has an improved flexing characteristic, i.e., vibration characteristic, without impairing at all the characteristics possessed by a carbon shaft.

For achieving the aforesaid object, a golf shaft according to the present invention comprises an inner layer having laminated reinforcing layers, in which layer a synthetic resin is immersed in a carbon fiber or a reinforcing fiber mainly comprising a carbon fiber, and an outer layer provided in the outer periphery of the inner layer, characterized in that the outer layer is provided on the surface thereof with a metal fiber in a state of being extended approximately in an axial direction of the shaft.

A golf shaft according to the present invention is preferably characterized by being provided with the following properties (1) to (3):

(1) Diameter of fiber: 30 to 150 $\mu$m (2) Tensile strength: 80 to 500 kgf/mm$^2$ (3) Modulus of elasticity: 10 to 25 tonf/mm$^2$ A golf shaft according to the present invention is preferably characterized in that the metal fiber is extended in the range of $\pm 5°$ with respect to an axis of the shaft.

A golf shaft according to the present invention is preferably characterized in that the metal fiber is arranged at intervals of 0.2 to 0.3 mm.

First, in the golf shaft according to the present invention, the metal fiber is provided on the surface of the outer layer while being extended approximately in an axial direction of the shaft.

By the provision of the metal fiber as described above, it is possible to obtain characteristics extremely close to the vibration characteristic of a steel shaft without impairing at all the characteristic of the shaft principally comprised of carbon fiber.

In preferred aspects of the golf shaft according to the present invention, the characteristic of the metal fiber is specified, the angle of the metal fiber with respect to the axis of the shaft is specified, and the spacing arrangement of the metal fiber is specified.

While the outline of the present invention has been briefly described, the features of the present invention will become completely apparent by reading the ensuing detailed description with reference to the accompanying drawings. It is to be noted that the drawings merely show one embodiment for the purpose of explaining the present invention and are not intended to limit the technical scope of the present invention.

BRIEF DESCRIPTION OF THE DRAWINGS

FIGS. 1 to 5 show one embodiment of a golf shaft according to the present invention, in which:

FIG. 1 is a cross sectional view of a golf shaft;

FIG. 2 is a plan view showing a part of a prepreg of metal fiber and carbon fiber;

FIG. 3 is a sectional view taken along line III—III of FIG. 2;

FIG. 4 is a chart showing characteristics of various metal fibers; and

FIGS. 5 (*a*) to 5 (*f*) show the steps of a method for manufacturing a golf shaft.

FIGS. 6 and 7 illustrate a conventional example, in which

FIG. 6 is a graph showing vibration characteristics; and

FIG. 7 is a side view showing a part of a golf shaft.

DESCRIPTION OF THE PREFERRED EMBODIMENTS

One embodiment of the present invention will be described hereinafter with reference to FIGS. 1 to 5.

Figure 1:
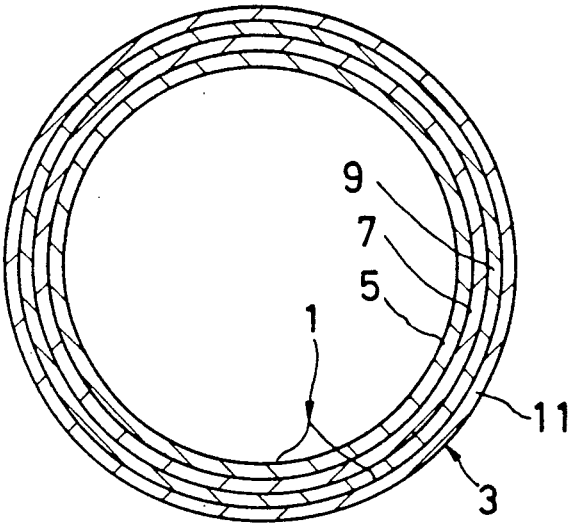

FIG. 1 is a cross sectional view of a golf shaft according to the present embodiment. A golf shaft comprises an inner layer 1 and an outer layer 3.

The inner layer 1 has a prepreg 5 of carbon fiber, a hybrid prepreg 7 of boron fiber and carbon fiber and a prepreg 9 of carbon fiber laminated in order from the inner side. On the other hand, the outer layer 3 is composed of a hybrid prepreg 11 of metal fiber and carbon fiber.

The prepreg will be described. The prepreg (pre-impregnated material) herein is a material in which a matrix resin is impregnated in a reinforcing fiber material to have a shape which can be easily molded. The reinforcing fibers have the following forms:

(1) Unidirectional prepreg
(1) Fabric prepreg
(3) Yarn prepreg
(4) Mat prepreg

The prepreg of carbon fiber mainly includes the unidirectional prepreg and the fabric prepreg. The yarn prepreg and the mat prepreg are often used minorly in a combination of the unidirectional prepreg and the fabric prepreg.

There are two methods for manufacturing a prepreg, i.e., a wet method and a dry method. The wet method is to melt a resin into a solvent to have a low viscosity before impregnation. The dry method is to heat material to have a low viscosity before impregnation.

The aforementioned prepreg 5 of carbon fiber, the hybrid prepreg 7 of boron fiber and carbon fiber and the prepreg 9 of carbon fiber use the carbon fiber, boron fiber and carbon fiber as the reinforcing fiber material and are manufactured by the above-described dry method and wet method.

Figure 2:
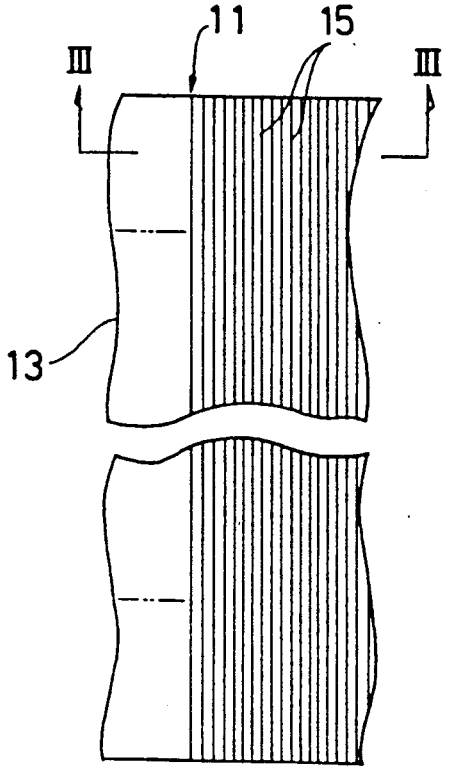
Figure 3:
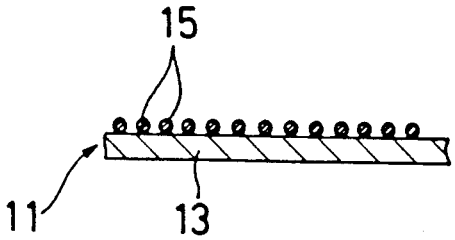
Figure 5A:
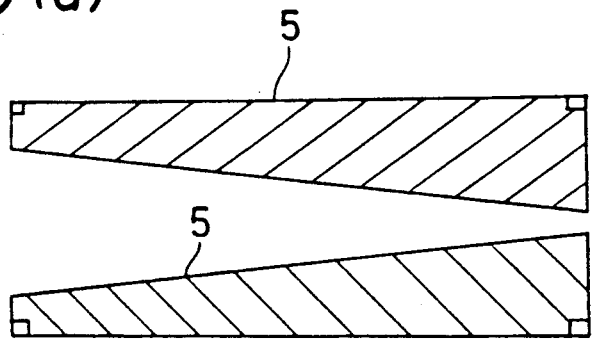
Figure 5B:
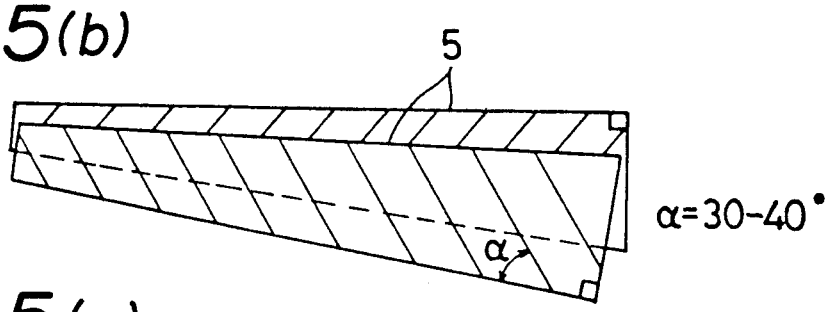
Figure 5C:
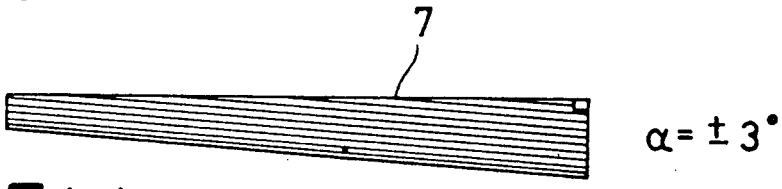
Figure 5D:
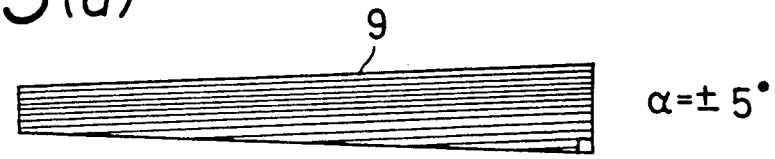
Figure 5E:
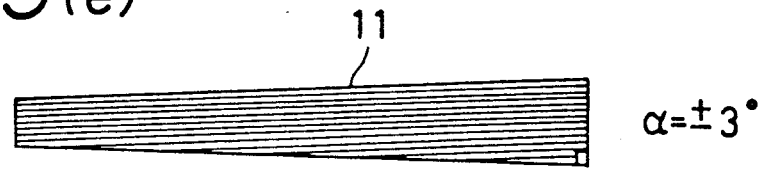
Figure 5F:
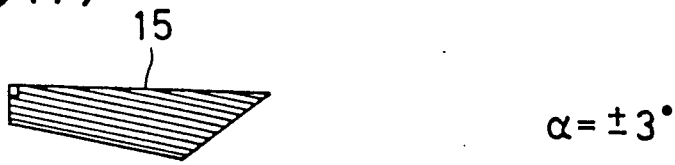
Figure 6:
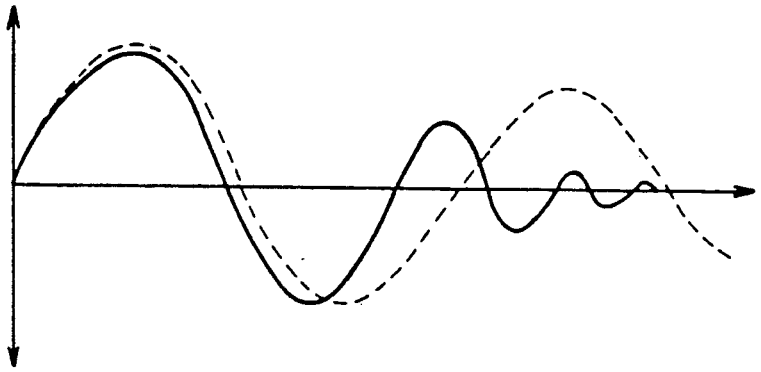
Figure 7:
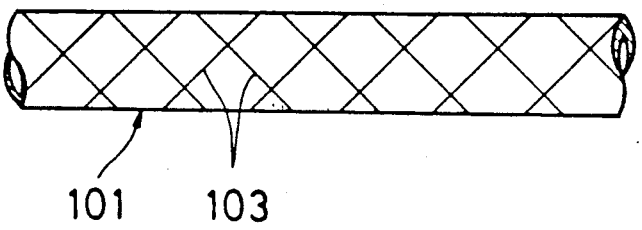

In the hybrid prepreg 11 of metal fiber and carbon fiber, as shown in FIG. 2, metal fibers 15 are extended approximately in an axial direction of the shaft on the surface of a sheet 13 of impregnated glass cloth. The hybrid prepreg has a cross sectional section as shown in FIG. 3. Actually, a sheet of carbon fiber is pressed on the metal fiber 15, but the carbon fiber sheet is not shown.

The hybrid prepreg 11 of metal fiber and carbon fiber is basically manufactured by the dry method or the wet method, but is different from conventional prepregs in that the prepreg 11 is provided on its surface with the metal fiber 15. The method for the manufacture of the prepreg will be described hereinafter.

First, a hot-melt-type thermosetting resin is coated on a plain weave glass cloth having a weight of 30 to 50 $g/m^2$, or the glass cloth is passed through the thermosetting resin so that resin is impregnated in the glass cloth to prepare a sheet 13. The ratio between the glass cloth and the thermosetting resin is such that the glass cloth is 40 to 65 in weight %.

Next, the sheet 13 is dried to the extent that the tip of a finger sticks thereto when depressed. After being dried, the sheet is wound on a drum in a state in which a polyethylene film (PE film, not shown) having a thickness of approximately 20 $\mu m$ is sandwiched as a separator.

The PE film is pasted on the outer peripheral surface of the drum in a state in which the PE film is positioned on the side of the drum. At this time, care is given so as not to produce wrinkles.

In this state, the metal fibers 15 are mounted to the sheet 13 at intervals of 0.2 to 0.8 mm while rotating the drum. The tension of the metal fiber 15 is preferably in the order of 30 to 250 g.

Next, the metal fiber 15 and the glass cloth sheet 13 impregnated with the resin are pressed by a roller.

Then, the material in which the metal fiber 15 and the glass cloth sheet 13 impregnated with the resin are pressed is removed from the drum, the carbon fiber sheet is pressed on the metal fiber 15, and the PE film is peeled off. The hybrid prepreg 11 of metal fiber and carbon fiber is now prepared. Thereafter the material is cut into a predetermined shape.

The metal fiber 15 will now be described. The metal fiber 15 used should be fulfilled with the following conditions (1) to (3):

(1) Diameter of fiber: 30 to 150 $\mu m$
(2) Tensile strength: 80 to 500 $kgf/mm^2$
(3) Modulus of elasticity: 10 to 25 $tonf/m^2$ Material fulfilled with the conditions (1) to (3) are shown in FIG. 4. In the case of the present invention, SUPER-FINE METAL (trade name, manufactured by K. K. Kobe Seikosho) is used.

The SUPER-FINE METAL is a superfine-diameter wire having a superhigh strength having superfine particles of 20 Å, which is excellent in mechanical properties such as bending, shearing and torsional deformation resistances, and high toughness.

Next, a method for manufacturing a golf shaft will be described. FIG. 5 shows the method for manufacturing a golf shaft in order of the steps. First, as shown in FIG. 5 (*a*), the carbon fiber prepreg 5 cut into a predetermined shape is drawn out and flattened to remove a twist.

Subsequently, a release medium is coated on an outer surface of a core not shown, a resin is coated thereon and the carbon fiber prepreg 5 is wound thereabout. At this time, the angle of the fiber is 30° to 40° with respect to the axis as shown in FIG. 5 (*b*).

Then, the hybrid prepreg 7 of boron fiber and carbon fiber is wound, as shown in FIG. 5 (*c*). The angle of the fiber is ±3° with respect to the axis.

As shown in FIG. 5 (*d*), the carbon fiber prepreg 9 is then wound. The angle of the fiber is ±5° with respect to the axis.

As shown in FIG. 5 (*e*), the prepreg 11 of metal fiber and carbon fiber is then wound. The angle of the fiber is ±3° with respect to the axis.

Further, as shown in FIG. 5 (*f*), the carbon fiber prepreg 15 cut into a predetermined shape is wound in order to strengthen a joined portion with respect to a head not shown. The angle of the fiber is ±3° with respect to the axis.

After all the prepregs have been wound, a polyester tape, a cellophane tape or polypropylene tape is wound thereabout. In this state, it is heated at 130° to 145° C. for 120 to 130 minutes to be hardened.

Upon completion of heating and hardening, the core is removed, the tape is peeled off and the surface is polished to make it smooth. Finally, a transparent coating is applied.

Next, the characteristics of the golf shaft according to the present embodiment will be described.

First, since the golf shaft is composed principally of carbon fiber, the golf shaft is light in weight and the characteristics of the conventional carbon shaft are maintained as they are.

Next, with respect to the flexure characteristic, since the metal fiber 15 is extended approximately in an axial direction of the shaft on the surface of the outer layer 3, a flexure characteristic close to that of the conventional metal shaft is obtained. Accordingly, sufficient "sense of flexure" is secured from the top swing through the down swing so that the head speed can be increased.

According to the above-described embodiment, the following effects are obtained.

First, it is possible to obtain a vibration characteristic extremely close to that of a steel shaft without impairing at all the characteristics of the conventional carbon shaft.

Secondly, since the metal fiber 5 is arranged on the surface, the wear resistance is enhanced, high resistance to bending, shearing and twisting are obtained, and the mechanical strength is improved.

In addition, since the metal fibers 15 arranged in order are visible, the golf shaft is excellent in terms of appearance.

While the preferred embodiment of the present invention has been described, it is evident that various changes and modifications thereof can be made without departing from the principle thereof. Accordingly, it will be appreciated that all modifications by which effects of the present invention are substantially obtained through the use of structures substantially similar or corresponding thereto are included in the scope of the invention.

What is claimed is:

1. A golf shaft having a central longitudinal axis, comprising an inner layer arranged circumferentially around said longitudinal axis, said inner layer comprising a plurality of laminated prepregs comprising carbon fibers; and an outer layer wrapped circumferentially around said inner layer, said outer layer comprising a sheet of resin-impregnated glass cloth, a plurality of metal fibers arranged on said glass cloth and extending approximately in the direction of said longitudinal axis, and a sheet of carbon fibers pressed onto said metal fibers.

2. A golf shaft as in claim 1, said plurality of laminated prepregs comprising a core prepreg of carbon fibers, a hybrid prepreg of carbon fibers and boron fibers wrapped circumferentially around said core prepreg, and a second prepreg of carbon fibers wrapped circumferentially around said hybrid prepreg.

3. A golf shaft as in claim 1, said metal fibers having a diameter of 30 to 150 $\mu$m, a tensile strength of 80 to 500 kgf/mm$^2$, and a modulus of elasticity of 10 to 25 tonf/mm$^2$.

4. A golf shaft as in claim 1, said metal fibers being arranged on said glass cloth in spaced relation at intervals of 0.2 to 0.8 mm.

5. A golf shaft as in claim 4, said metal fibers being arranged on said glass cloth in spaced relation at interval of 0.2 to 0.3 mm.

6. A golf shaft as in claim 1, said metal fibers being arranged on said glass cloth at an angle of about 3° to about 5° with respect to the longitudinal axis of said shaft.

7. A golf shaft as in claim 1, said metal fibers being arranged on said glass cloth at an angle of about 5° with respect to the longitudinal axis of said shaft.

8. A golf shaft as in claim 2, said core prepreg comprising resin-impregnated carbon fibers arranged at an angle of about 30° to about 40° with respect to the longitudinal axis of said shaft.

9. A golf shaft as in claim 2, said hybrid prepreg comprising carbon fibers and boron fibers arranged at an angle of about 3° with respect to the longitudinal axis of said shaft.

10. A golf shaft as in claim 2, said second prepreg comprising carbon fibers arranged at an angle of about 5° with respect to the longitudinal axis of said shaft.

11. A golf shaft as in claim 1, wherein said resin-impregnated glass cloth comprises 40 to 65% by weight glass cloth.

12. A golf shaft as in claim 1, wherein said sheet of carbon fibers comprises carbon fibers arranged at an angle of about 3° with respect to the longitudinal axis of said shaft.

* * * * *